US005993680A

United States Patent [19]

Sugiyama et al.

[11] Patent Number: 5,993,680

[45] Date of Patent: Nov. 30, 1999

[54] METHOD OF REMOVING HARD CARBON FILM FORMED ON INNER CIRCUMFERENTIAL SURFACE OF GUIDE BUSH

[75] Inventors: Osamu Sugiyama, Tokorozawa; Yukio Miya, Kawagoe; Ryota Koike, Tokorozawa; Takashi Toida, Tokyo; Toshiichi Sekine, Kamifukuoka, all of Japan

[73] Assignee: Citizen Watch Co., Ltd., Tokyo, Japan

[21] Appl. No.: 09/051,456

[22] PCT Filed: Aug. 15, 1997

[86] PCT No.: PCT/JP97/02840

§ 371 Date: Apr. 13, 1998

§ 102(e) Date: Apr. 13, 1998

[87] PCT Pub. No.: WO98/06885

PCT Pub. Date: Feb. 19, 1998

[30] Foreign Application Priority Data

Aug. 15, 1996 [JP] Japan ..... 8-215560

[51] Int. Cl.[6] ..... B44C 1/22

[52] U.S. Cl. ..... 216/81; 216/67; 427/577

[58] Field of Search ..... 216/81, 67; 427/577

[56] References Cited

U.S. PATENT DOCUMENTS 5,160,405 11/1992 Miyauchi et al. ..... 216/67

5,458,733 10/1995 Tessmer et al. ..... 216/67

5,679,269 10/1997 Cohen et al. ..... 216/72

FOREIGN PATENT DOCUMENTS 7-44037 2/1995 Japan .

8-225944 9/1996 Japan .

9-38801 2/1997 Japan .

*Primary Examiner*—Bruce Breneman

*Assistant Examiner*—Shamim Ahmed

*Attorney, Agent, or Firm*—Armstrong, Westerman, Hattori, McLeland & Naughton

[57] ABSTRACT

The present invention provides a method of removing a hard carbon film (15) from the inner surface of a guide bush (11) through etching. The method comprises the steps of inserting an auxiliary electrode (71) in the center bore (11j) of the guide bush (11) wherein the hard carbon film (15) is formed over the inner surface thereof, in sliding contact with a workpiece, disposing the guide bush (11) with the auxiliary electrode inserted in the center bore thereof in a vacuum vessel (61) provided with an anode (79) and a filament (81) therein, grounding the auxiliary electrode (71) or applying a positive DC voltage thereto, and producing a plasma in the vacuum vessel (61) by feeding an oxygen-containing gas therein and applying a DC voltage to the anode (79) and an AC voltage to the filament (81) respectively, while applying a DC voltage to the guide bush (11) after evacuating the vacuum vessel (61).

15 Claims, 9 Drawing Sheets

METHOD OF REMOVING HARD CARBON FILM FORMED ON INNER CIRCUMFERENTIAL SURFACE OF GUIDE BUSH

TECHNICAL FIELD

The present invention relates to a method of removing a hard carbon film formed over the inner surface in sliding contact with a workpiece of a guide bush mounted in an automatic lathe to hold the work piece rotatably.

BACKGROUND TECHNOLOGY

Guide bushes mounted on a column of an automatic lathe to hold a rod-like workpiece rotatably at a position close to a cutting tool are classified into a rotary type and a stationary type. A rotary guide bush rotates together with a workpiece and holds the workpiece for axial sliding. A stationary guide bush remains stationary and holds a workpiece for rotation and axial sliding.

A guide bush of either type has a portion having a taper outer surface provided with slits to make the same portion elastic, a threaded portion to hold the guide bush on the column, and an inner surface for holding a workpiece. The inner surface always in sliding contact with a workpiece is liable to be worn and, particularly, the inner surface of a stationary guide bush is worn rapidly.

Therefore, we have already proposed a guide bush wherein a hard carbon film is formed over the inner surface thereof coming in sliding contact with a workpiece when the workpiece is rotated and slid so as to dramatically enhance wear resistance of the inner surface and prevent seizure from occurring between the inner surface and workpiece.

The hard carbon film is formed of a hydrogenated amorphous carbon closely resembling diamond in properties. Therefore, hydrogenated amorphous carbon is also called diamond-like carbon (DLC).

The hard carbon film (DLC film) has a high hardness (not lower than Vickers 3000 Hv), is excellent in wear resistance and corrosion resistance, and has a small coefficient of friction (about ⅛ that of a superhard alloy).

The guide bush having an inner surface to be in sliding contact with a workpiece, coated with the hard carbon film, has wear resistance more excellent than the conventional guide bush having an inner surface attached with a superhard alloy or a ceramic material.

Accordingly, an automatic lathe employing the stationary guide bush provided with the hard carbon film over the inner surface thereof as described above is able to achieve heavy machining, in which depth of cut is large and cutting speed is high, with high accuracy for an extended period of time without damaging the workpiece or causing seizure.

Further, the hard carbon film may preferably be formed on an intermediate layer formed over the inner surface of the guide bush to enhance adhesion between the inner surface and the hard carbon film.

When the intermediate layer is formed of a two-layer film consisting of a lower layer of titanium, chromium or a compound containing titanium or chromium, and an upper layer of silicon, germanium or a compound containing silicon or germanium, the lower layer secures adhesion to the inner surface (alloy tool steel as a substrate metal) of the guide bush, and the upper layer bonds firmly to the hard carbon film. Therefore, the hard carbon film adheres firmly to the inner surface of the guide bush with high adhesion.

The hard carbon film may be formed on a hard lining member of a superhard alloy, such as tungsten carbide (WC), or a sintered ceramic material, such as silicon carbide (SiC), formed on the inner surface of the guide bush. An intermediate layer interposed between such a hard lining member and the hard carbon film will further enhance the adhesion of the hard carbon film.

Even if the guide bush is provided with the hard carbon film over the inner surface thereof as described above, however, the necessity for removing the hard carbon film from the inner surface thereof will arise so as to render the guide bush reusable in case any defect in the hard carbon film is detected during a test after formation thereof, the hard carbon film is damaged after use over a long period of time, or any other trouble is found occurring thereto.

In such a case, it is conceivable to remove the hard carbon film formed over the inner surface of the guide bush by use of a conventional technique such as the plasma etching method.

FIG. 10 is a view for illustrating a method of removing the hard carbon film from the inner surface of a guide bush by use of the plasma etching method.

As shown in the figure, a guide bush 11 with a hard carbon film 15 formed over the inner surface thereof is disposed inside a vacuum vessel 61, having a gas inlet port 63 and an evacuation port 65, and provided with an anode 79 and a filament 81 in the upper part therein, and securely held by insulated holding members 80.

The vacuum vessel 61 is then evacuated by means for evacuation (not shown), removing air through the evacuation port 65. Thereafter, a DC voltage supplied from an anode power source 75 is applied to the anode 79 disposed opposite to the guide bush 11, and an AC voltage supplied from a filament power source 77 is applied to the filament 81 while a DC voltage supplied from a DC power source 73 is applied to the guide bush 11.

Simultaneously, an oxygen-containing gas is fed into the vacuum vessel 61 through the gas inlet port 63, causing an oxygen plasma to be produced within the vacuum vessel 61 so that the hard carbon film 15 formed over the inner surface of the guide bush 11 is removed through etching as a result of oxygen reacting with carbon in the hard carbon film.

With the use of such a method of removing as described above, however, it is impossible to completely remove the hard carbon film 15 formed over the inner surface of the guide bush 11 from the entire region of the inner surface.

This is because with the method of removing as shown in FIG. 10, the plasma entering the center bore 11*j* of the guide bush 11 from the open end face thereof does not sufficiently reach the innermost region in the center bore 11*j*, thus failing to produce a uniformly distributed plasma therein.

Consequently, the hard carbon film formed on the inner surface of the guide bush 11, in the vicinity of the open end face thereof, can be removed by etching, but same formed on the innermost side (toward the lower part in FIG. 10) of the inner surface of the guide bush 11 can not.

A method according to the invention has been developed to overcome the problem described above, and it is therefore an object of the invention to provide a method whereby the hard carbon film formed over the inner surface of the guide bush can be removed from the entire region of the inner surface thereof with certainty.

DISCLOSURE OF THE INVENTION

The present invention provides a method of removing a hard carbon film from the inner surface of a guide bush by use of the plasma etching method described in the foregoing, characterized in that an auxiliary electrode is inserted in a center bore of the guide bush and is grounded, or a positive AC voltage is applied thereto, in order to achieve the object described above.

That is, the method of removing the hard carbon film from the inner surface of the guide bush according to the invention comprises the following steps of:

inserting an auxiliary electrode in the center bore of the guide bush wherein the hard carbon film has been formed over the inner surface thereof, in sliding contact with a workpiece;

disposing the guide bush with the auxiliary electrode inserted in the center bore thereof in a vacuum vessel;

grounding the auxiliary electrode or applying a positive DC voltage thereto; and producing a plasma in the vacuum vessel by feeding an oxygen-containing gas therein after evacuating the vacuum vessel, the hard carbon film being removed from the inner surface of the guide bush through etching caused by a reaction of oxygen with carbon in the hard carbon film.

There are various methods of producing a plasma inside the vacuum vessel, for example: a method of applying a DC voltage to an anode disposed in the vacuum vessel and an AC voltage to a filament also disposed in the vacuum vessel, respectively while applying a DC voltage to the guide bush; a method of applying RF electric power to the guide bush; or a method of applying only a DC voltage thereto; and the like.

For the oxygen-containing gas fed into the vacuum vessel, an oxygen gas only, a mixed gas of oxygen and argon, a mixed gas of oxygen and nitrogen, or a mixed gas of oxygen and hydrogen may be used.

With the method according to the invention, since the auxiliary electrode inserted in the center bore of the guide bush is grounded or supplied with a DC voltage, a plasma discharge is caused to occur between the auxiliary electrode and the guide bush to which a DC voltage or an RF voltage is applied. Consequently, an oxygen plasma is produced throughout the center bore of the guide bush, and the hard carbon film can be removed through etching from the entire region of the inner surface of the guide bush due to the reaction occurring between the oxygen and carbon in the hard carbon film.

When a positive DC voltage is applied to the auxiliary electrode, this will have the effect of collecting electrons together in a region between the inner surface of the guide bush and the auxiliary electrode, that is, a region surrounding the auxiliary electrode, raising the density of electrons in the region.

As a result, the probability of molecules of the oxygen-containing gas colliding with electrons is naturally increased, promoting ionization of the gas molecules and causing the plasma density in the region surrounding the auxiliary electrode to become higher. Accordingly, the speed at which the hard carbon film is removed increases corresponding to the voltage applied.

Further, with the method of the invention, even if the diameter of the center bore of the guide bush becomes smaller, the plasma can be produced within the center bore, enabling the hard carbon film formed over the inner surface to be removed.

BEST MODE FOR CARRYING OUT THE INVENTION

A method of removing a hard carbon film formed over the inner surface of a guide bush according to the preferred embodiments in carrying out the invention will be described hereinafter with reference to the drawings.

Description of an automatic lathe employing a guide bush

The construction of an automatic lathe employing a guide bush to which the present invention is applicable will be briefly described hereinafter.

Figure 11:
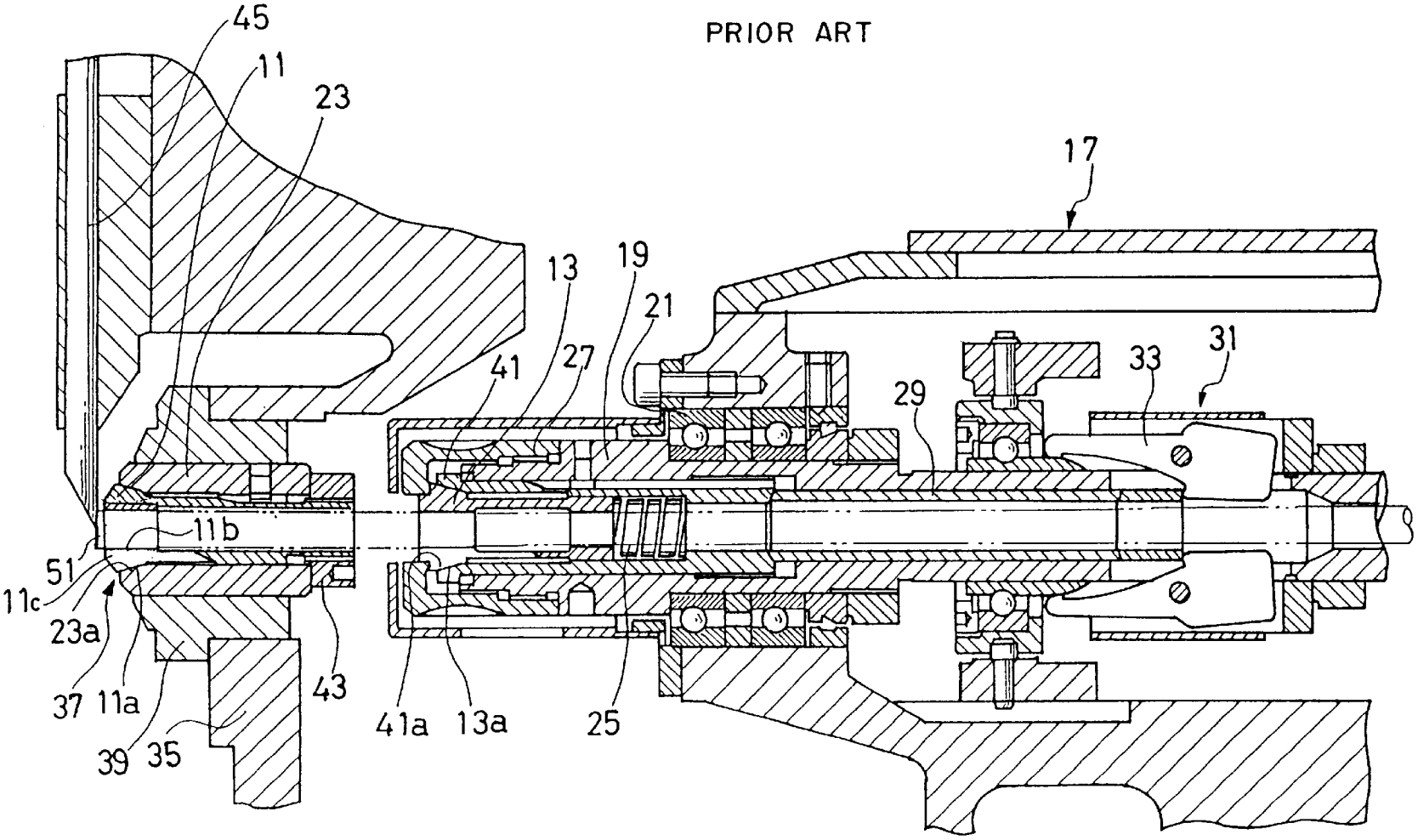
FIG. 11 PRIOR ART
FIG. 11 is a sectional view of an automatic lathe provided with a stationary guide bush unit showing only a spindle and associated parts thereof.

FIG. 11 shows only a spindle and associated parts of a numerically controlled automatic lathe in a sectional view. The automatic lathe is provided with a stationary guide bush unit 37 that holds a guide bush 11 fixedly to support a workpiece 51 (indicated by imaginary lines) rotatably on the inner surface 11*b* of the guide bush 11.

A spindle stock 17 is mounted on the bed, not shown, of the numerically controlled automatic lathe for sliding movement in transverse directions, as viewed in FIG. 11.

A spindle 19 is supported for rotation in bearings 21 on the spindle stock 17, and a collet chuck 13 is mounted on the front end of the spindle 19.

The collet chuck 13 having a taper outer surface 13*a* is inserted in the center bore of a chucking sleeve 41 with the taper outer surface 13*a* on the front end thereof in close contact with a taper inner surface 41*a* of the chucking sleeve 41.

A coil spring 25 formed by winding a spring band is inserted in an intermediate sleeve 29 at the back end of the collet chuck 13. The collet chuck 13 can be pushed out of the intermediate sleeve 29 by the action of the coil spring 25.

The position of the front end of the collet chuck 13 is contacted and determined by a cap nut 27 fastened to the front end of the spindle 19 with screws. The cap nut 27 restrains the collet chuck 13 from being pushed out of the intermediate sleeve 29 by the force of the coil spring 25.

A chuck operating mechanism 31 provided with chuck operating levers 33 is provided on the back end of the intermediate sleeve 29. The chuck operating levers 33 are operated to open or close the collet chuck 13 so that the collet chuck 13 releases or chucks the workpiece 51.

When the chuck operating levers 33 of chuck operating mechanism 31 are turned so that the front ends thereof are moved away from each other, operating portions of the chuck operating levers 33 in contact with the intermediate sleeve 29 move to the left, as viewed in FIG. 11 to push the intermediate sleeve 29 to the left. Consequently, the chucking sleeve 41 in contact with the left end of the intermediate sleeve 29 moves to the left.

The collet chuck 13 is restrained from being pushed out of the spindle 19 by the cap nut 27 fastened to the front end of the spindle 19 with screws.

Therefore, when the chucking sleeve 41 is moved to the left, the taper inner surface 41*a* of the chucking sleeve 41 is pressed against the taper outer surface 13*a* of the slitted, coned head portion of the collet chuck 13 and the taper inner surface 41*a* of the chucking sleeve 41 moves along the tapered surface.

Consequently, the inside diameter of the collet chuck 13 is reduced to grip the workpiece 51.

When releasing the workpiece 51 from the collet chuck 13 by increasing the inside diameter of the collet chuck 13, the chuck operating levers 33 are turned so that the front ends thereof are moved toward each other to remove the force acting to the left on the chucking sleeve 41.

Then, the intermediate sleeve 29 and the chucking sleeve 41 are moved to the right as viewed in FIG. 11 by the stored energy of the coil spring 25.

Consequently, the pressure applied to the taper outer surface 13*a* of the collet chuck 13 by the taper inner surface 41*a* of the chucking sleeve 41 is removed to allow the collet chuck 13 to expand by its own resilience, so that the inside diameter of the collet chuck 13 increases to release the workpiece 51.

A column 35 is disposed in front of the spindle stock 17 and the guide bush unit 37 is placed on the column 35 with its center axis aligned with that of the spindle.

The guide bush unit 37 is of a stationary type fixedly holding the guide bush 11 to support the workpiece 51 rotatably on the inner surface 11*b* of the guide bush 11.

A bush sleeve 23 is fitted in the center bore of a holder 39 fixed to the column 35. A taper inner surface 23*a* is formed in the front end portion of the bush sleeve 23.

The guide bush 11 having a front end portion provided with a taper outer surface 11*a* and slits 11*c* are fitted in the center bore of the bush sleeve 23.

The clearance between the inner surface of the guide bush 11 and the outer surface of the workpiece 51 can be adjusted by turning an adjusting nut 43 screwed on the threaded portion of the guide bush 11 and contiguous with the back end of the guide bush unit 37.

When the adjusting nut 43 is turned clockwise, the guide bush 11 moves to the right, as viewed in FIG. 11, relative to the bush sleeve 23 and the taper outer surface 11*a* of the guide bush 11, similarly to the taper outer surface of the collet chuck 13, being pressed against the taper inner surface 23*a* of the bush sleeve 23, and the inside diameter of the slitted front end portion of the guide bush 11 is reduced.

A cutting tool (cutter) 45 is disposed in further front of the guide bush unit 37.

The workpiece 51 is chucked by the collet chuck 13 mounted on the spindle 19 and supported by the guide bush unit 37. A portion of the workpiece 51 projecting from the guide bush unit 37 into a machining region is machined for predetermined machining by a combined motion of the cross feed motion of the cutting tool 45 and the longitudinal transverse motion of the spindle stock 17.

Figure 12:
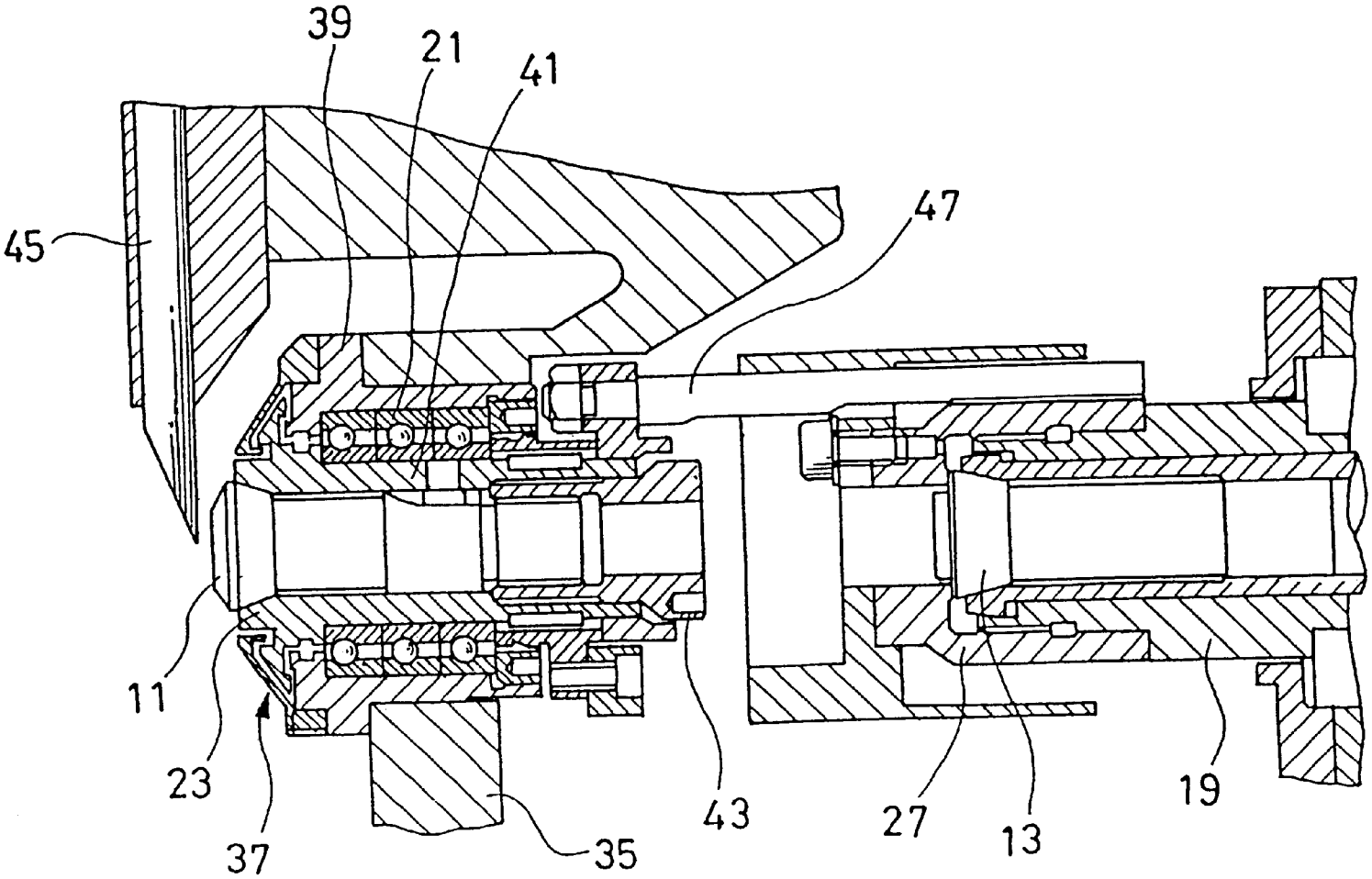
FIG. 12 PRIOR ART
FIG. 12 is a sectional view of an automatic lathe provided with a rotary guide bush unit showing only a spindle and associated parts thereof.

A rotary guide bush unit that rotatably employs a guide bush gripping a workpiece will be described with reference to FIG. 12, in which parts like or corresponding to those shown in FIG. 11 are designated by the same reference numerals.

Rotary guide bush units are classified into those holding the guide bush 11 so as to rotate in synchronism with the collet chuck 13 and those holding the guide bush 11 so as to rotate in asynchronism with the collet chuck 13. The guide bush unit 37 shown in FIG. 12 holds the guide bush 11 so as to rotate in synchronism with the collet chuck 13.

The rotary guide bush unit 37 is driven by a drive rod 47 projecting from the cap nut 27 mounted on the spindle 19. A gear mechanism or a belt-and-pulley mechanism may be used instead of the drive rod 47 for driving the guide bush unit 37.

The rotary guide bush unit 37 has a holder 39 fixed to a column 35. A bush sleeve 23 is inserted in the center bore of the holder 39 and is supported in bearings 21 on the holder 39, and the guide bush 11 is fitted in the center bore of the bush sleeve 23.

The bush sleeve 23 and the guide bush 11 are similar in construction to those illustrated in FIG. 11, respectively. The internal diameter of the guide bush 11 can be reduced and the clearance between the inner surface of the guide bush 11 and the outer surface of the workpiece 51 can be adjusted by turning an adjusting nut 43 screwed on the threaded portion of the guide bush 11 which is contiguous with the back end of the guide bush unit 37.

This automatic lathe is the same in construction as the automatic lathe illustrated in FIG. 11 except that this automatic lathe is provided with the rotary guide bush unit 37, and hence further description thereof will be omitted.

Description of the guide bush provided with the hard carbon film formed over the inner surface thereof Now the guide bush from the inner surface of which the hard carbon film is to be removed by the method of the invention is described hereinafter.

Figure 8:
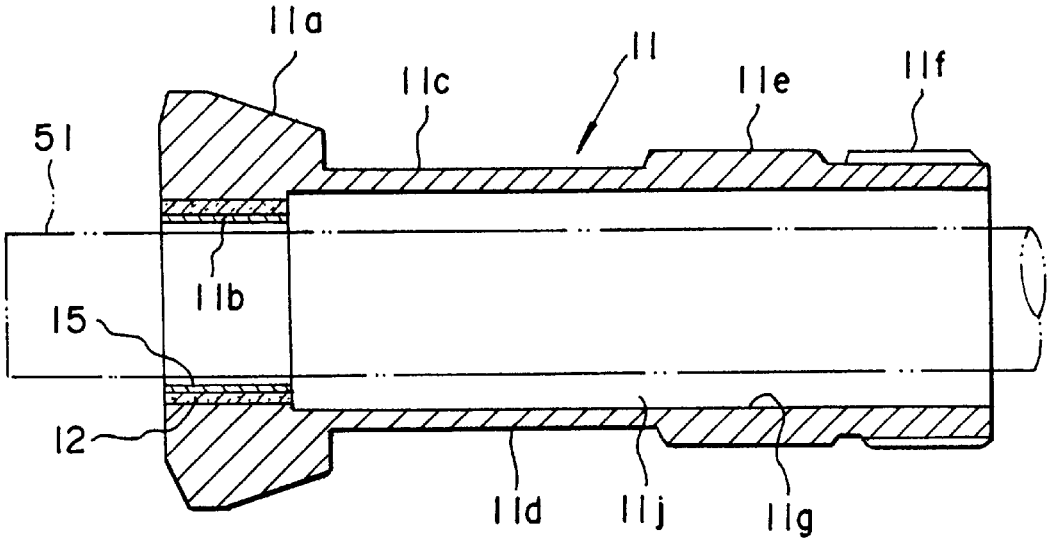
FIG. 8 is a longitudinal sectional view of the guide bush, from the inner surface of which the hard carbon film is exfoliated by the method according to the invention, and FIG. 9 a perspective view of same.
Figure 9:
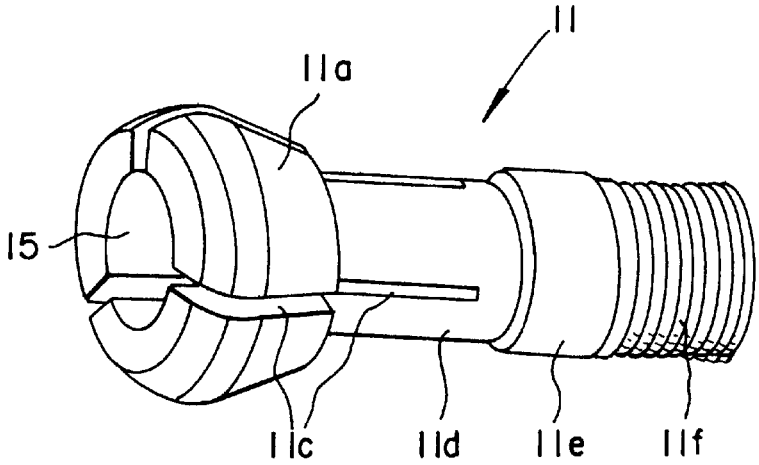
Figure 10:
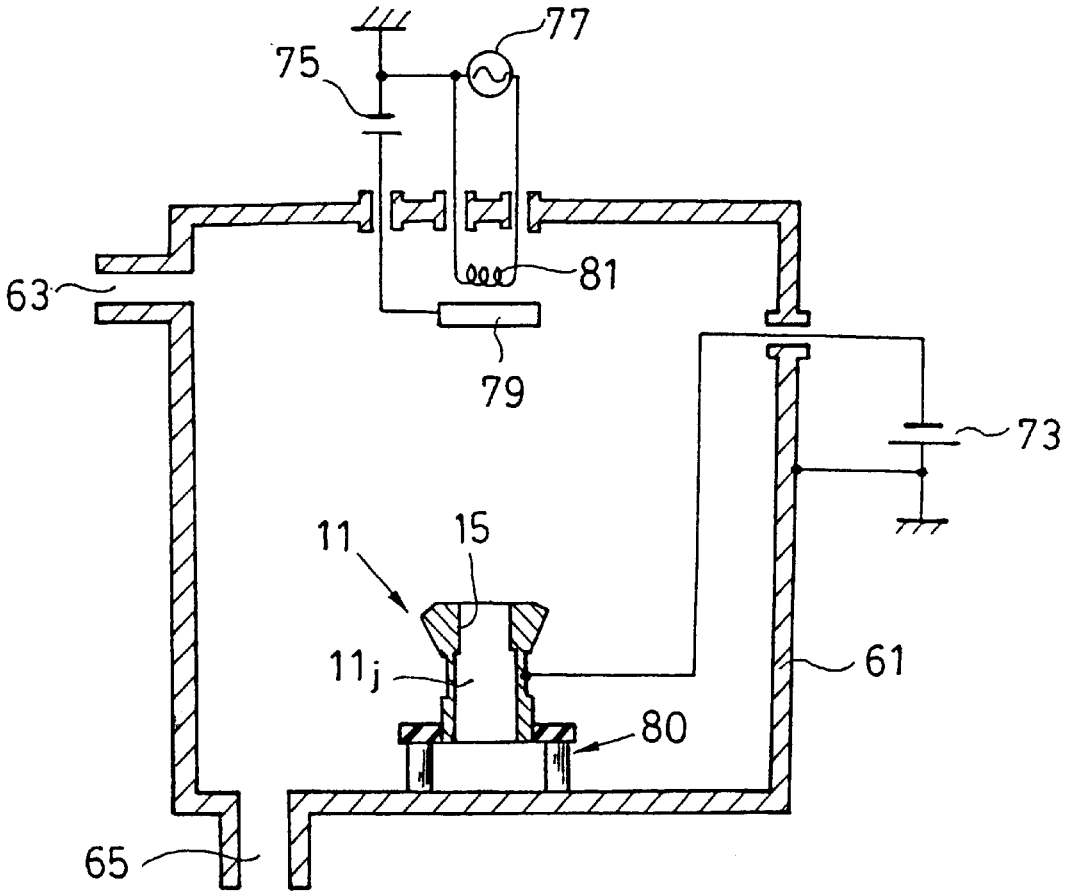
FIG. 10 PRIOR ART
FIG. 10 is a schematic sectional view, similar to FIG. 1, illustrating an apparatus used in carrying out a conventional method of removing by means of plasma etching the hard carbon film formed over the inner surface of the guide bush.

FIGS. 8 and 9 are a longitudinal sectional view and a perspective view, respectively, of the guide bush by way of example.

Referring to FIGS. 8 and 9, the guide bush 11 is shown in a free state in which a front end portion is open. The guide bush 11 has a head portion having a taper outer surface 11*a* at one longitudinal end thereof, and a threaded portion 11*f* at the other longitudinal end thereof.

Further, the guide bush has a center bore 11*j*, formed along the center axis thereof, having an internal diameter different from that of other parts, and an inner surface 11*b* for holding a workpiece 51, inside the head portion having the taper outer surface 11*a*. The guide bush is also provided with a stepped portion 11*g* with an internal diameter greater than that of the inner surface 11*b*, formed in the region of the center bore other than the inner surface 11*b*.

The guide bush 11 is provided with three slits 11*c* cut at angular intervals of 120° so as to divide the taper outer surface 11*a* into three equal parts in a region thereof extending from the head portion having the taper outer surface 11*a* to an elastic bendable portion 11*d*.

The clearance between the inner surface 11*b* and the workpiece 51 indicated by imaginary lines in FIG. 8 can be adjusted by pressing the taper outer surface 11*a* of the guide bush 11 against the taper inner surface of the bush sleeve, so that the elastic bendable portion 11*d* is bent.

The guide bush 11 has a fitting portion 11*e* between the elastic bendable portion lid and the threaded portion 11*f*. When the fitting portion 11*e* is fitted in the center bore of the bush sleeve 23 (FIGS. 11 and 12), the guide bush 11 can be disposed with its axis in alignment with the center axis of the spindle.

The guide bush 11 is made of an alloy tool steel (SK steel). When forming the guide bush 11, a workpiece of alloy tool steel is machined in predetermined external and internal shapes, and the machined workpiece is subjected to quenching and annealing.

Preferably, a superhard lining 12 of thickness in the range of 2 to 5 mm may be secured to the guide bush 11 as shown in FIG. 8 by brazing to form the inner surface 11*b* to come in sliding contact with the workpiece 51.

For the superhard lining, use can be made of an alloy containing, for example, 85 to 90% tungsten (W), 5 to 7% carbon (C), and 3 to 10% cobalt (Co) as a binder.

A clearance in the range of 5 to 10 $\mu$m is formed between the inner surface 11*b* and the workpiece 51 in the radial direction thereof in a state where the taper outer surface 11*a* is closed. Thus the workpiece 51 slides relative to the inner surface 11*b* of the guide bush 11, the frictional wear of the inner surface 11*b* becomes problem.

When the guide bush 11 is used on a stationary guide bush unit, the workpiece 51 supported on the stationary guide bush 11 rotates at a high speed to be machined. That is, the inner surface 11*b* and the workpiece 51 slide with each other at a high speed. Further, since the workpiece 51 is applied an excessively high pressure to the inner surface 11*b* by a machining load, so the problem of seizing may occur.

Therefore, the hard carbon film (DLC film) 15 described in the foregoing is formed over the inner surface 11*b* of the guide bush 11, and the thickness thereof is set to be in the range of 1 to 5 $\mu$m.

As described hereinbefore, the hard carbon film is very similar to diamond in properties, having a high mechanical strength, a small coefficient of friction, a satisfactory self-lubricity, and excellent corrosion resistance.

The hard carbon film 15 covering the inner surface 11*b* enhances the wear resistance of the guide bush 11 remarkably, the guide bush 11 withstands an extended period of use and heavy machining, and the wear of the inner surface 11*b* in contact with the workpiece 51 is reduced. Further, abrasive damage to the workpiece 51 can be reduced, and seizing between the guide bush 11 and the workpiece 51 can be avoided.

The hard carbon film may be formed directly over the inner surface of a substrate metal (SKS) forming the guide bush 11, or the superhard lining 12. However, it may preferably be formed with an intermediate layer (not shown) thin in thickness interposed between the inner surface 11*b* and the hard carbon film in order to enhance adhesion with the inner surface 11*b*.

The intermediate layer may be composed of an element belonging to sub-group IV b in the periodic table of elements, such as silicon (Si), germanium (Ge), or a compound containing silicon or germanium. Or a compound containing carbon, such as a silicon carbide (SiC) or titanium carbide (TiC), may also be used.

For the intermediate layer, a compound of silicon (Si) and an element selected from the group consisting of titanium (Ti), tungsten (W), molybdenum (Mo) and tantalum (Ta) may also be used.

The intermediate layer may be a two-layer film consisting of a lower layer composed of titanium (Ti) or chromium (Cr), and an upper layer composed of silicon (Si) or germanium (Ge).

With the intermediate layer formed as described above, titanium or chromium in the lower layer thereof serves for maintaining adhesion with the substrate metal of the guide bush 11 or the superhard lining 12, and silicon or germanium in the upper layer thereof serves for reinforcing bonding with the hard carbon film 15 through covalent bond therewith.

The thickness of the intermediate layer described above is set to be on the order of 0.5 $\mu$m. However, in the case where the intermediate layer is formed of the two-layer film, the thickness of the upper and lower layers, respectively, is set to be on the order of 0.5 $\mu$m.

However, there will be cases where the hard carbon film formed over the inner surface of the guide bush needs to be removed as described hereinbefore.

The invention provides a method whereby the hard carbon film 15 can be removed in such a case from the entire region of the inner surface 11*b* of the guide bush 11 rapidly and with certainty.

Figure 1:
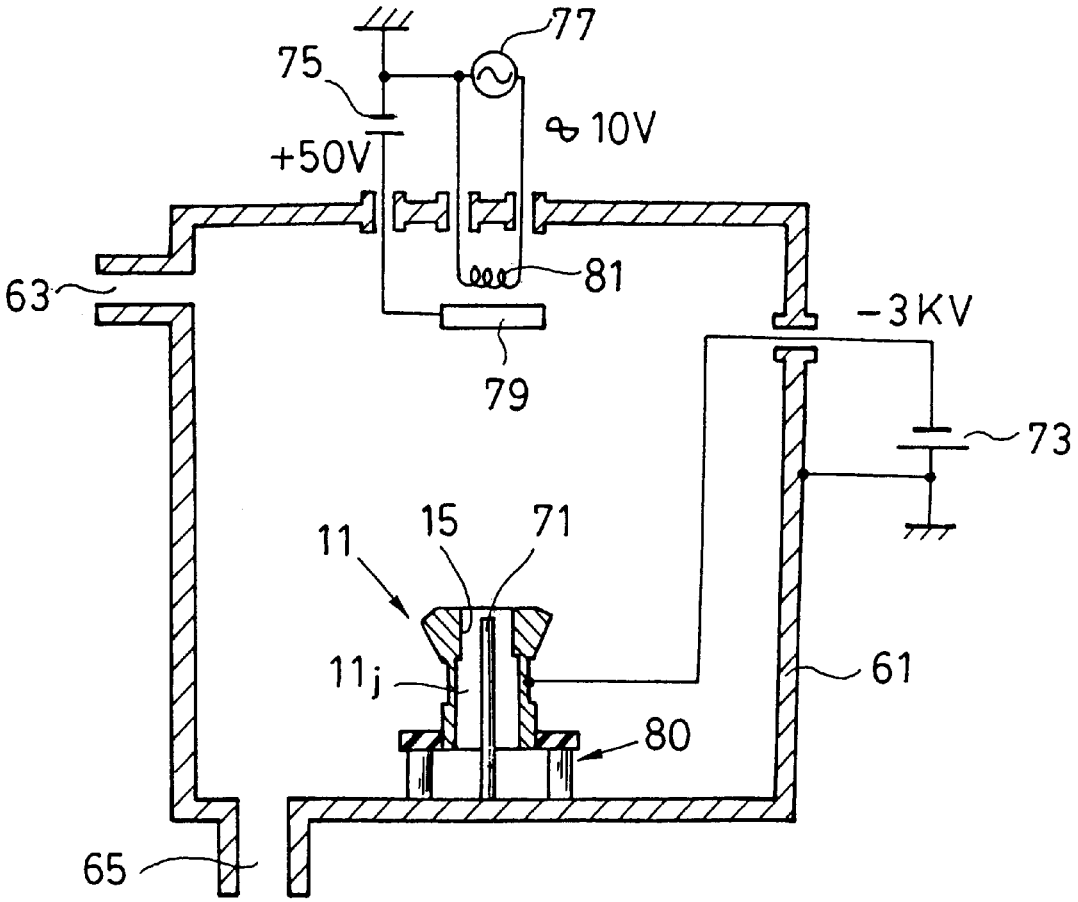
FIGS. 1 to 6 are schematic sectional views illustrating apparatuses used in carrying out various embodiments, respectively, of a method of removing a hard carbon film formed over the inner surface of a guide bush according to the invention.

First Embodiment: FIG. 1

A first embodiment of the invention is described hereinafter. FIG. 1 is a schematic sectional view of an apparatus used in carrying out the first embodiment.

As shown in FIG. 1, the guide bush 11 with the hard carbon film 15 formed over the inner surface thereof, coming in sliding contact with a workpiece is disposed inside a vacuum vessel 61, having a gas inlet port 63 and an evacuation port 65, and provided with an anode 79 and a filament 81 in the upper part therein. The guide bush 11 is securely held by insulated holding members 80 in electrical isolation from the vacuum vessel 61.

Also an auxiliary electrode 71 in rod-like form is inserted into the center bore 11*j* of the guide bush 11 to be disposed therein so as to be in alignment with the center axis of the center bore 11*j* of the guide bush 11. The auxiliary electrode is made of a metal such as stainless steel and the like, is electrically connected to the grounded vacuum vessel 61 also made of a metal, and is thereby put at a ground potential via the vacuum vessel 61.

The vacuum vessel 61 is then evacuated by means for evacuation (not shown), removing air through the evacuation port 65 until the degree of vacuum comes down to not more than $3\times10^{-5}$ torr.

Thereafter, oxygen ($O_2$) as an oxygen-containing gas is fed into the vacuum vessel 61 through the gas inlet port 63, controlling a pressure inside the vacuum vessel 61 to $3\times10^{-3}$ torr.

Then a DC voltage at +50V supplied from an anode power source 75 is applied to the anode 79, and an AC voltage at 10V is applied to the filament 81 so that 30A current flows from a filament power source 77 while a DC voltage at −3 kV from a DC power source 73 is applied to the guide bush 11.

This will cause an oxygen plasma to be produced in the region in close proximity of the guide bush 11 inside the vacuum vessel 61, whereupon plasma discharge also occurs inside the center bore 11*j* of the guide bush 11 to which a high negative DC voltage is applied, that is, between the inner surface of the guide bush and the auxiliary electrode 71 at the ground potential, producing a large amount of oxygen plasma from the oxygen-containing gas fed into the vacuum vessel 61.

Consequently, the oxygen reacts with carbon in the hard carbon film 15, etching and removing the hard carbon film 15 from the entire region of the inner surface of the guide bush. Thus the hard carbon film 15 is completely removed.

The auxiliary electrode 71 disposed in the center bore 11*j* along the central axis of the guide bush 11 causes plasma discharge characteristics to become uniform along the whole length of the center bore 11*j*. As a result, any dispersion in distribution of intensity of the plasma produced over the inner surface of the guide bush 11 is prevented, and by the agency of the oxygen plasma evenly distributed therein, the hard carbon film 15 can be removed from the inner surface through even etching from the vicinity of the open end face to the innermost portion side of the center bore.

An auxiliary electrode 71 with a diameter smaller than that of the center bore 11*j* can be used, but the diameter thereof may preferably be set such that a region for the oxygen plasma production is confined within a clearance on the order of 4 mm formed between the inner surface of the guide bush and the auxiliary electrode 71. Furthermore, the ratio of the diameter of the auxiliary electrode 71 to that of the center bore 11*j* of the guide bush 11 may preferably be set to not more than 1/10, and the auxiliary electrode 71 may be formed in the shape of a wire when rendering it thinner. The auxiliary electrode 71 is made of a metal such as stainless steel (SUS), or a metal having a high melting point such as tungsten (W) or tantalum (Ta).

Further, the auxiliary electrode 71 may be circular in cross section, and may have a length such that the tip thereof is flush with, or may preferably be inside of, the open end face of the guide bush 11 by 1 to 2 mm as shown in the figure so as not to allow the tip of the auxiliary electrode 71 to be protruded from the open end face of the guide bush 11 when inserted in the guide bush 11.

Figure 2:
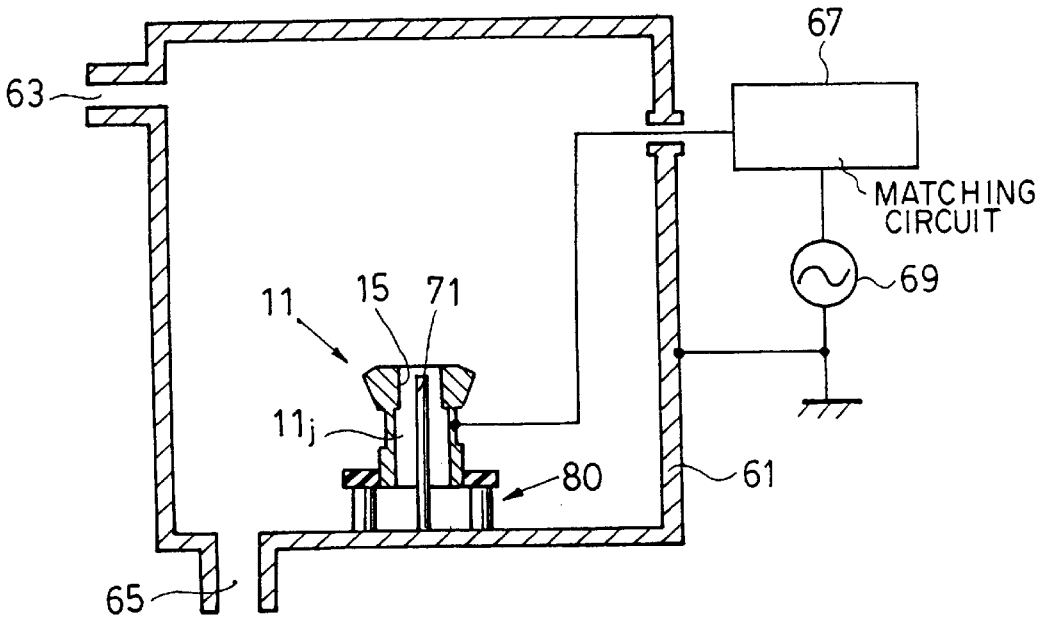

Second Embodiment: FIG. 2

Now a second embodiment of the invention will be described hereinafter with reference to FIG. 2.

FIG. 2 is a schematic sectional view of an apparatus used in carrying out the second embodiment, wherein parts similar to those described with reference to FIG. 1 are denoted by the same reference numerals, and description thereof is omitted.

Inside the vacuum vessel 61 used in carrying out the second embodiment, parts corresponding to the anode 79 and the filament 81 described in FIG. 1 are not provided.

Similarly to the case of the first embodiment, the guide bush 11 is disposed inside the vacuum vessel 61, and the auxiliary electrode 71 inside the center bore 11*j* of the guide bush 11.

After the vacuum vessel 61 is evacuated by removing air through an evacuation port 65 until the degree of vacuum comes down to not more than $3\times10^{-5}$ torr, oxygen ($O_2$) as an oxygen-containing gas is fed into the vacuum vessel 61 through the gas inlet port 63, adjusting the degree of vacuum inside the vacuum vessel 61 to 0.3 torr.

Thereafter RF power of 300 W supplied from an RF power source 69 at an oscillation frequency of 13.56 MHz is applied to the guide bush 11 via a matching circuit 67, producing a plasma in a region surrounding the guide bush 11 disposed inside the vacuum vessel 61, and within the center bore 11*j*.

Consequently, as in the case of the first embodiment, the hard carbon film 15 can be removed from the entire inner surface 11*b* of the guide bush 11.

As the operation and effect of the auxiliary electrode 71 in this case are similar to those in the case of the first embodiment, further description thereof is omitted.

Figure 3:
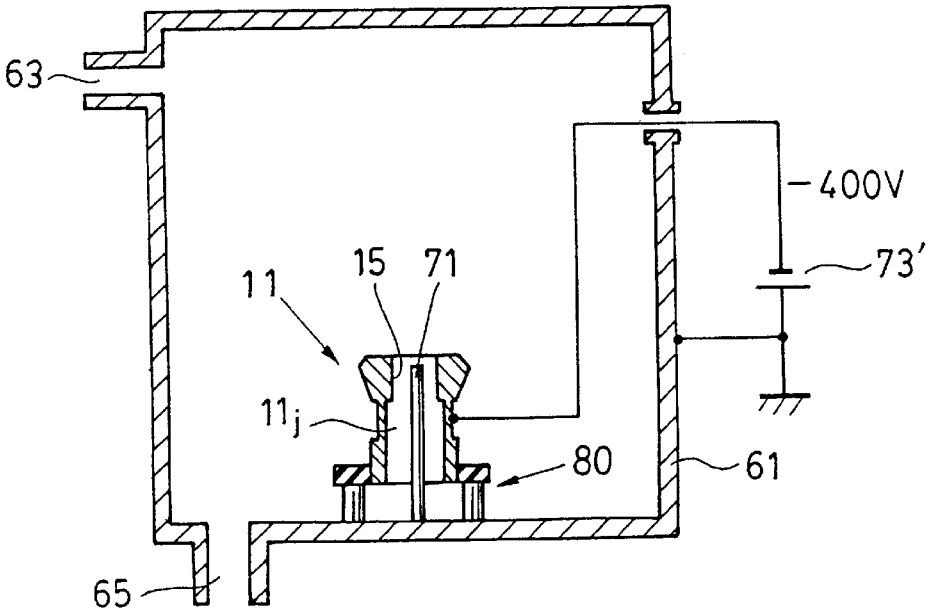

Third Embodiment: FIG. 3

A third embodiment of the invention is described hereinafter with reference to FIG. 3.

FIG. 3 is a schematic sectional view of an apparatus used in carrying out the third embodiment, wherein parts similar to those described with reference to FIG. 1 are denoted by the same reference numerals, and description thereof is omitted.

Inside the vacuum vessel 61 used in carrying out the third embodiment, parts corresponding to the anode 79 and the filament 81 described in FIG. 1 are not provided, either.

Similarly to the case of the first embodiment described above, the guide bush 11 is disposed inside the vacuum vessel 61, and the auxiliary electrode 71 inside the center bore 11*j* of the guide bush 11.

After the vacuum vessel 61 is evacuated by removing air through the evacuation port 65 until the degree of vacuum comes down to not more than $3\times10^{-5}$ torr, oxygen ($O_2$) as an oxygen-containing gas is fed into the vacuum vessel 61 through the gas inlet port 63, adjusting the degree of vacuum inside the vacuum vessel 61 to be at 0.3 torr.

Thereafter a DC voltage at −400V from a DC power source 73' is applied to the guide bush 11, producing a plasma in a region surrounding the guide bush 11 disposed inside the vacuum vessel 61, and within the center bore 11*j*.

Consequently, the hard carbon film 15 can be removed from the entire inner surface of the guide bush 11.

As the third embodiment is similar to the first and second embodiments described hereinbefore except that the plasma is produced by applying only a DC voltage to the guide bush 11, the operation and effect thereof are also similar, and description thereof is omitted.

Fourth, Fifth, and Sixth Embodiments: FIGS. 4 to 7

Now, fourth, fifth, and sixth embodiments of the invention will be described hereinafter with reference to FIGS. 4 to 7.

Figure 4:
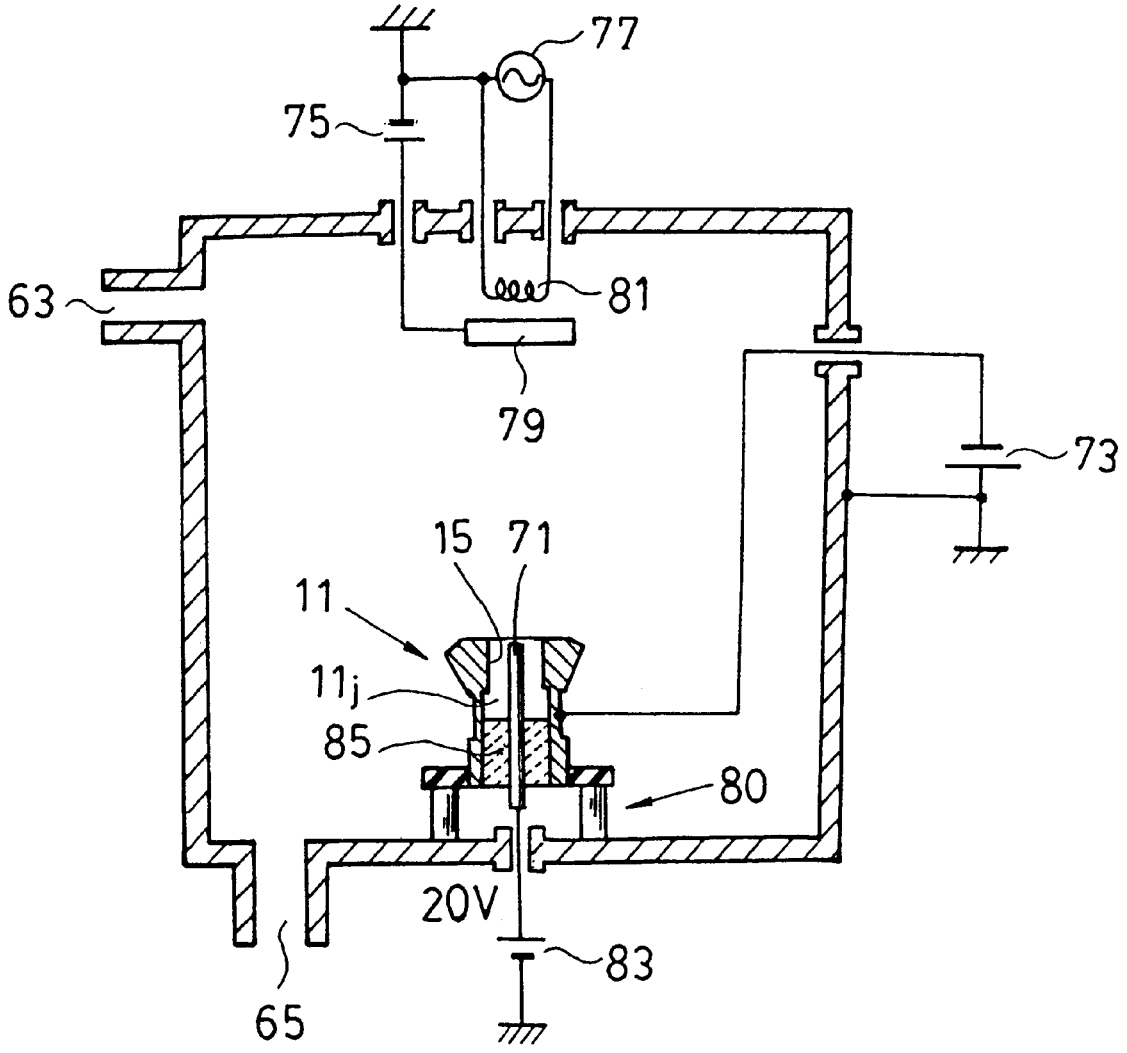
Figure 5:
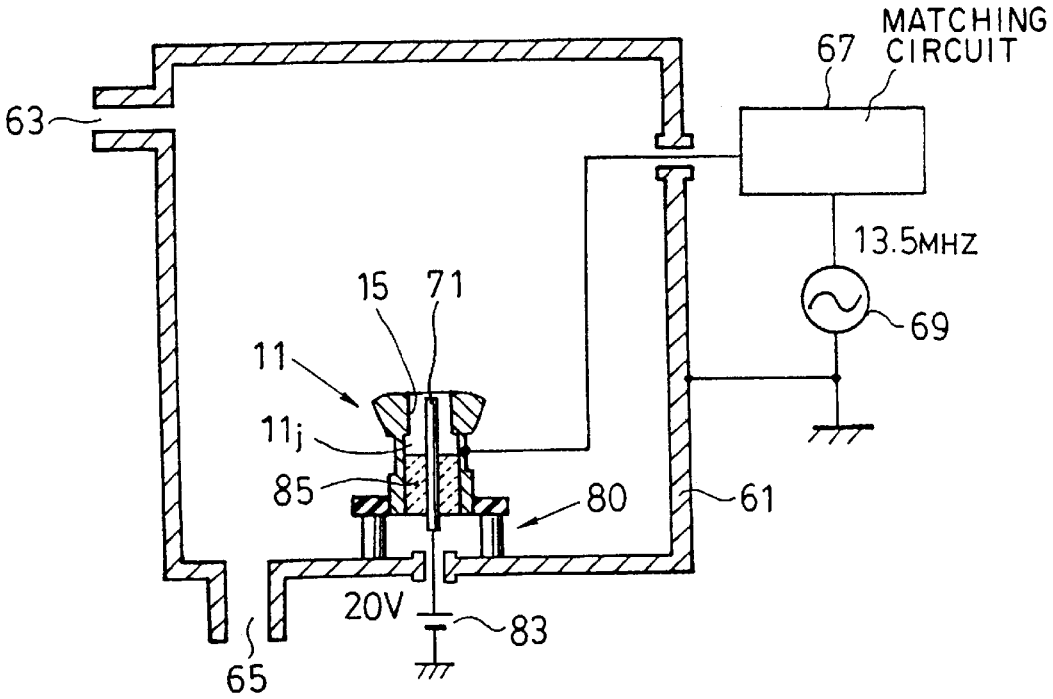
Figure 6:
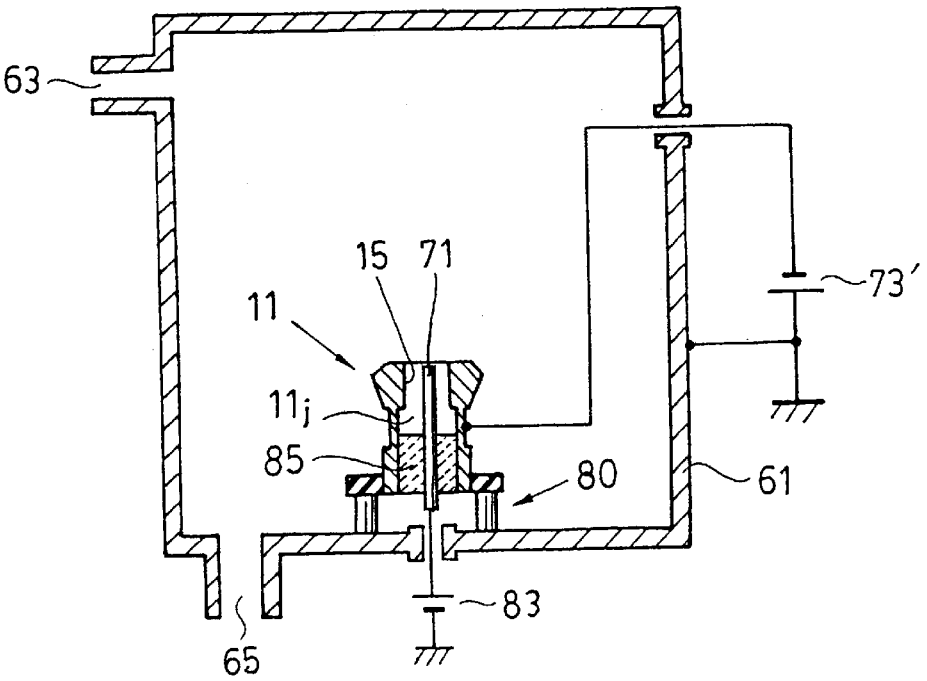

FIGS. 4 to 6 are schematic sectional views of an apparatus used in carrying out the fourth, fifth, and sixth embodiments of the invention, respectively, wherein a method of producing a plasma, similar to that shown in FIGS. 1 to 3, respectively, is used.

The fourth, fifth, and sixth embodiments differ from the first, second, and third embodiments, respectively, only in that an auxiliary electrode 71 is held by an insulating member 85 such as an insulator, set in a stepped portion of the center bore 11*j* of the guide bush 11, so as to be electrically insulated from both the guide bush 11 and the vacuum vessel 61 so that a positive DC voltage from an auxiliary electrode power source 83 is applied to the auxiliary electrode 71.

Figure 7:
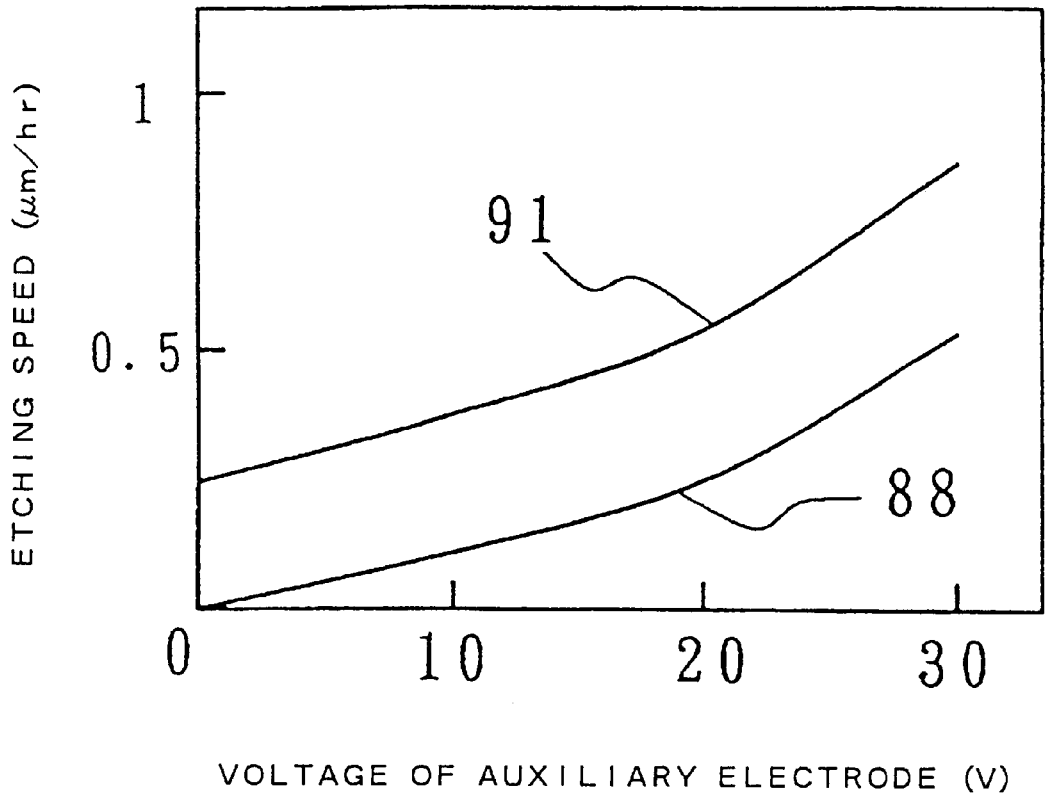
FIG. 7 is a diagram showing a relationship between voltages applied to an auxiliary electrode and etching speeds of the hard carbon film according to embodiments shown in FIGS. 4 to 6, respectively.

The relationship between voltages applied to the auxiliary electrode as described above and speeds at which the hard carbon film is etched from the inner surface of the guide bush is shown in FIG. 7.

FIG. 7 is a graph showing etching speeds of the hard carbon film when the positive DC voltage applied to the auxiliary electrode 71 is varied from 0V to 30V, provided that the curve 88 indicates the characteristic of the relationship when a clearance between the inner surface of the guide bush 11 and the auxiliary electrode 71 is 3 mm, while curve 91 indicates same when the clearance is 5 mm.

As the curves 88 and 91 in FIG. 7 clearly show, the etching speed of the hard carbon film increases as the positive DC voltage applied to the auxiliary electrode 71 from the auxiliary electrode power source 83 is increased. Further, the greater the size of the clearance between the inner surface of the bore of the guide bush 11 and the auxiliary electrode 71, the higher the etching speed of the hard carbon film.

In the case where the size of the clearance between the inner surface of the bore of the guide bush 11 and the auxiliary electrode 71 is 3 mm as indicated by the curve 88, an oxygen plasma is not produced in the center bore 11*j* of the guide bush 11 when the voltage applied to the auxiliary electrode 71 is 0V at the ground potential with the result that the hard carbon film can not be removed.

However, as the voltage applied to the auxiliary electrode 71 is raised, the oxygen plasma is caused to be produced around the auxiliary electrode 71 in the center bore 11*j* of the guide bush 11 even in the case where the clearance between the inner surface of the bore of the guide bush 11 and the auxiliary electrode 71 is 3 mm, enabling the hard carbon film to be removed.

Accordingly, in the embodiments of the invention as shown in FIGS. 4 to 6, respectively, the hard carbon film 15 is removed through etching by applying a positive DC voltage from the auxiliary electrode power source 83 to the auxiliary electrode 71 disposed in the central region of the center bore 11*j* of the guide bush 11.

Such an arrangement as described above has the effect of gathering electrons together in a region between the inner surface of the center bore of the guide bush 11 and the auxiliary electrode 71, that is, a region surrounding the auxiliary electrode 71 to which a positive DC voltage is applied, increasing the electron density in the region surrounding the auxiliary electrode 71.

With such an increase in the electron density as described above, the probability of oxygen-containing gas molecules colliding with electrons becomes naturally higher, promoting ionization of the gas molecules, and increasing the plasma density in the region surrounding the auxiliary electrode 71.

Consequently, the speed at which the hard carbon film is exfoliated from the inner surface of the guide bush 11 becomes higher in comparison with that when no voltage is applied to the auxiliary electrode 71.

Further, in the case where the inside diameter of the guide bush 11 becomes smaller, rendering the size of the clearance between the inner surface of the center bore 11*j* and the auxiliary electrode 71 also smaller, an attempt to remove the hard carbon film without applying a positive voltage to the auxiliary electrode 71 will fail, and the hard carbon film can not be removed through etching because then the plasma is not produced inside the center bore 11*j*. On the other hand, forced concentration of electrons in the region surrounding the auxiliary electrode 71 by applying a positive voltage to the auxiliary electrode 71 as practiced in these embodiments as described can cause the plasma to be produced around the auxiliary electrode 71.

Consequently, it becomes possible to remove the hard carbon film 15 through etching from the entire region of the inner surface of the guide bush 11.

The material used for and shape of the auxiliary electrode 71 are not different from those for the first embodiment.

Examples of gases in use, other than an oxygen-containing gas

In the foregoing description of the first to the sixth embodiments of the invention, the case of using oxygen gas for the oxygen-containing gas has been described. However, a mixed gas of oxygen and argon (Ar), oxygen and nitrogen ($N_2$), or oxygen and hydrogen ($H_2$) other than the oxygen gas may be used for the same purpose. When any of these gases is used in any of the embodiments described above, the same effect can be obtained in carrying out any of the embodiments of the invention.

Furthermore, in the case of using a mixed gas of oxygen and argon (Ar), etching for removing the hard carbon film is promoted due to a synergistic effect of reactive etching by oxygen and physical etching by argon ions.

Also, in the case of using a mixed gas of oxygen and nitrogen, etching for removing the hard carbon film is promoted due to a synergistic effect of reactive etching by oxygen and physical etching by nitrogen ions. The effect of the physical etching by nitrogen ions is not so great as in the case of argon ions, but there is, however, no risk of etching the substrate metal composing the guide bush after the hard carbon film is removed.

In the case of using a mixed gas of oxygen and hydrogen as well, the speed at which the hard carbon film is removed becomes higher as reaction of oxygen with carbon in the hard carbon film is promoted by the presence of the hydrogen.

INDUSTRIAL APPLICABILITY

As is evident from the description mentioned hereinbefore, by use of the method according to the invention, a hard carbon film formed over the inner surface of a guide bush can be removed from the entire region of the inner surface thereof rapidly and with certainty. Even a hard carbon film formed over the inner surface of a guide bush that is small in its inside diameter can be removed through etching with ease.

Accordingly, should any defect be found in a hard carbon film formed over the inner surface of a guide bush, or if degradation occurs to the hard carbon film formed over the inner surface of the guide bush after use thereof over a long period of time, the hard carbon film can be removed from the inner surface of the guide bush by use of the method of the invention efficiently and with certainty. Hence, the guide bush can be restored and be put to use again with ease by forming a new hard carbon film over the inner surface thereof, coming in sliding contact with a workpiece.

What is claimed is:

1. A method of removing a hard carbon film formed over the inner surface of a guide bush comprising steps of:

inserting an auxiliary electrode in a center bore of the guide bush wherein the hard carbon film is formed over the inner surface thereof, in sliding contact with a workpiece;

disposing the guide bush with the auxiliary electrode inserted in the center bore thereof in a vacuum vessel provided with an anode and a filament therein;

grounding the auxiliary electrode or applying a positive DC voltage thereto;

feeding an oxygen-containing gas into the vacuum vessel after evacuating same; and producing a plasma inside the vacuum vessel by applying a DC voltage to the anode and an AC voltage to the filament while applying a DC voltage to the guide bush, the hard carbon film being removed from the inner surface of the guide bush through etching.

2. A method of removing a hard carbon film formed over the inner surface of a guide bush comprising steps of:

inserting an auxiliary electrode in a center bore of the guide bush wherein the hard carbon film is formed over the inner surface thereof, in sliding contact with a workpiece;

disposing the guide bush with the auxiliary electrode inserted in the center bore thereof in a vacuum vessel;

grounding the auxiliary electrode or applying a positive DC voltage thereto;

feeding an oxygen-containing gas into the vacuum vessel after evacuating same; and producing a plasma inside the vacuum vessel by applying RF power to the guide bush, the hard carbon film being removed from the inner surface of the guide bush through etching.

3. A method of removing a hard carbon film formed over the inner surface of a guide bush comprising steps of:

inserting an auxiliary electrode in a center bore of the guide bush wherein the hard carbon film is formed over the inner surface thereof, in sliding contact with a workpiece;

disposing the guide bush with the auxiliary electrode inserted in the center bore thereof in a vacuum vessel;

grounding the auxiliary electrode or applying a positive DC voltage thereto;

feeding an oxygen-containing gas into the vacuum vessel after evacuating same; and producing a plasma inside the vacuum vessel by applying a DC voltage to the guide bush, the hard carbon film being removed from the inner surface of the guide bush through etching.

4. A method of removing a hard carbon film formed over the inner surface of a guide bush according to claim 1, wherein the oxygen-containing gas is oxygen gas.

5. A method of removing a hard carbon film formed over the inner surface of a guide bush according to claim 2, wherein the oxygen-containing gas is oxygen gas.

6. A method of removing a hard carbon film formed over the inner surface of a guide bush according to claim 3, wherein the oxygen-containing gas is oxygen gas.

7. A method of removing a hard carbon film formed over the inner surface of a guide bush according to claim 1, wherein the oxygen-containing gas is a mixed gas of oxygen and argon.

8. A method of removing a hard carbon film formed over the inner surface of a guide bush according to claim 2, wherein the oxygen-containing gas is a mixed gas of oxygen and argon.

9. A method of removing a hard carbon film formed over the inner surface of a guide bush according to claim 3, wherein the oxygen-containing gas is a mixed gas of oxygen and argon.

10. A method of removing a hard carbon film formed over the inner surface of a guide bush according to claim 1, wherein the oxygen-containing gas is a mixed gas of oxygen and nitrogen.

11. A method of removing a hard carbon film formed over the inner surface of a guide bush according to claim 2, wherein the oxygen-containing gas is a mixed gas of oxygen and nitrogen.

12. A method of removing a hard carbon film formed over the inner surface of a guide bush according to claim 3, wherein the oxygen-containing gas is a mixed gas of oxygen and nitrogen.

13. A method of removing a hard carbon film formed over the inner surface of a guide bush according to claim 1, wherein the oxygen-containing gas is a mixed gas of oxygen and hydrogen.

14. A method of removing a hard carbon film formed over the inner surface of a guide bush according to claim 2, wherein the oxygen-containing gas is a mixed gas of oxygen and hydrogen.

15. A method of removing a hard carbon film formed over the inner surface of a guide bush according to claim 3, wherein the oxygen-containing gas is a mixed gas of oxygen and hydrogen.

* * * * *